United States Patent [19]

Jacuzzi et al.

[11] 4,153,954

[45] May 15, 1979

[54] COMBINATION TUB AND SHOWER WITH HYDROMASSAGE

[75] Inventors: Roy A. Jacuzzi, Moraga; Ralph D'Innocente, Pleasant Hill, both of Calif.

[73] Assignee: Jacuzzi Whirlpool Bath, Inc., Walnut Creek, Calif.

[21] Appl. No.: 858,119

[22] Filed: Dec. 7, 1977

[51] Int. Cl.[2] ..... A47K 3/08; A47K 3/16; A61H 9/00

[52] U.S. Cl. ..... 4/148; 4/175; 4/180; 52/35; 52/221; 128/66

[58] Field of Search ..... 4/145–148, 4/173 R, 175, 178, 180, 2, 4, 5, 149, 154, 161, 162, 183; 128/66, 365, 371; D23/55; 52/35, 221

[56] References Cited

U.S. PATENT DOCUMENTS

| | | | |
|---|---|---|---|
| 3,297,025 | 1/1967 | Jacuzzi | 4/180 X |
| 3,722,152 | 3/1973 | Schlatter | 52/35 X |
| 3,736,924 | 6/1973 | Jacuzzi et al. | 4/180 |
| 3,864,760 | 2/1975 | Bowen | 4/148 X |

FOREIGN PATENT DOCUMENTS

| | | | |
|---|---|---|---|
| 647937 | 12/1950 | United Kingdom | 4/154 |

*Primary Examiner*—Stuart S. Levy
*Attorney, Agent, or Firm*—Flehr, Hohbach, Test, Albritton & Herbert

[57] ABSTRACT

A combination tub and shower for installation in a home as a unit, an enclosure formed of a generally horizontal bottom wall and a substantially vertical sidewall extending upwardly from the bottom wall to a height which is greater than that of an adult human being so that the enclosure can serve as a shower stall. The sidewall has an opening formed therein which is spaced a substantial distance above the bottom wall so that the lower portion of the enclosure can serve as a tub for an adult human being. The opening serves to permit ingress and egress of a human being with respect to the shower stall and the tub. A vertically extending wall member is secured to the enclosure and extends outwardly from one side of the enclosure and has a frontal surface which faces in generally the same direction as the opening in the enclosure. The wall member is provided with access openings therein to permit access to the space behind the wall member so that plumbing connections for the tub and the shower stall can be made through the access openings. A removable panel is secured to the wall member and serves to close the access openings.

12 Claims, 4 Drawing Figures

COMBINATION TUB AND SHOWER WITH HYDROMASSAGE

BACKGROUND OF THE INVENTION

Because of increased labor costs, the cost of construction of housing has greatly accelerated during recent years. There is therefore a need for elimination of construction which has a high labor content as for example bathrooms in homes, apartments, condominiums and the like. Built-in hydromassage units have been provided in bathtubs such as disclosed in U.S. Pat. No. 3,297,025 and U.S. Pat. No. 3,571,820 and 3,874,374. There is, however, a need for a combination tub and shower with hydromassage which can be readily installed as a unit with a minimum amount of labor. There is also a need for such a unit which can be installed in the space provided for a conventional shower. There is also a need for such a unit which can be installed in new housing or which alternatively can be utilized for a replacement for a conventional shower in existing housing. There is therefore a need for a new improved combination tub and shower and particularly one which incorporates hydromassage.

SUMMARY OF INVENTION AND OBJECTS

The combination tub and shower for installation in housing as a unit consists of a shell-like enclosure formed with a generally horizontal bottom wall and a substantially vertical sidewall extending upwardly from the bottom wall to a height which is greater than that of a human being so that the enclosure can serve as a shower stall. The sidewall is provided with an opening which is formed therein and which is spaced a substantial distance from the bottom wall so that the lower portion of the enclosure can serve as a tub for an adult human being. The opening is utilized to permit ingress and egress of the human being with respect to the shower stall and the tub. The vertical wall-like member is secured to one side of the enclosure and is provided with a frontal surface which faces in the same direction as the opening. The vertical extending wall member serves as one side of a service compartment that is to the rear of the vertical wall member and which is utilized for making electrical and plumbing connections. A plurality of openings are provided in the vertical wall member to provide access to the service compartment. An access panel is removably secured to the front wall to close the access openings.

In general it is an object of the present invention to provide a combination tub and shower which is formed as a unit for installation in housing.

Another object of the invention is to provide a combination tub and shower of the above character which can be installed in the same area as a standard cove.

Another object of the invention is to provide a combination tub and shower of the above character in which a deep tub has been provided to permit hydromassage bathing.

Another object of the invention is to provide a combination tub and shower of the above character which can be utilized as a shower.

Another object of the invention is to provide a combination tub and shower of the above character which is formed of a heat retaining material and which can readily be installed as a unit.

Another object of the invention is to provide a combination tub and shower of the above character which can be factory wired and plumbed.

Another object of the invention is to provide a combination tub and shower of the above character in which electrical and plumbing connections can be made from the floor up.

Another object of the invention is to provide a combination tub and shower of the above character in which a service compartment is provided for making electrical and plumbing connections which are accessible from the front.

Another object of the invention is to provide a combination tub and shower of the above character in which access openings are provided for ready access to the service compartment.

Another object of the invention is to provide a combination tub and shower of the above character in which a removable decorative panel is provided for closing the access opening.

Another object of the invention is to provide a combination tub and shower of the above character in which the choice of the shower head and spout can be made by the customer.

Another object of the invention is to provide a combination tub and shower of the above character which is relatively light in weight and which can be readily shipped to the construction site.

Another object of the invention is to provide a combination tub and shower of the above character which can be readily leveled and nailed in place by use of nailing strips provided on the unit.

Another object of the invention is to provide a combination tub and shower of the above character which can be readily maintained.

Another object of the invention is to provide a combination tub and shower of the above character in which all of the controls for the user are located in a localized area of the tub.

Another object of the invention is to provide a combination tub and shower of the above character in which the service area compartment is located immediately adjacent to and opposite the sidewall in which the controls are located so that the controls can be readily plumbed and wired.

Additional features and objects of the invention will appear from the following description in which the preferred embodiment is set forth in detail in the drawings.

DESCRIPTION OF THE PREFERRED EMBODIMENT

Figure 1:
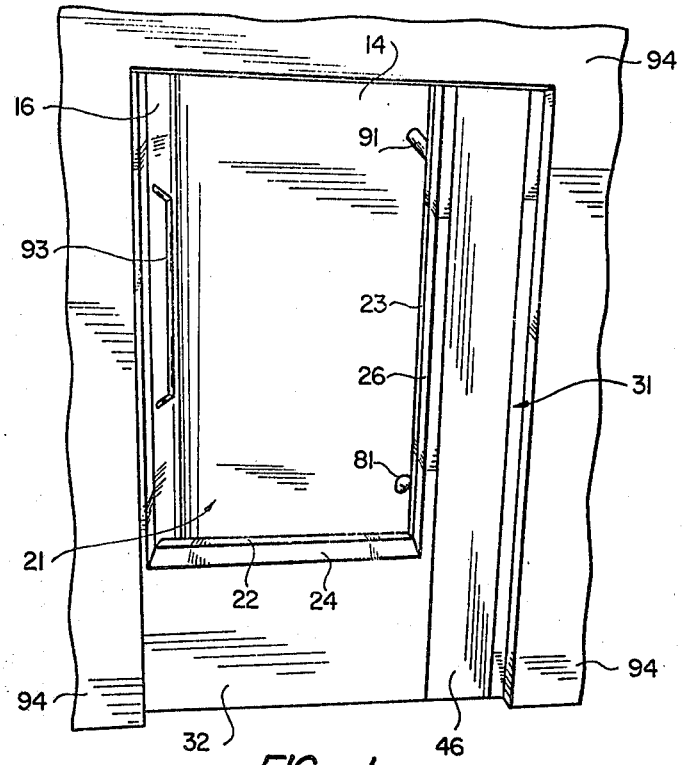
FIG. 1 is a frontal elevation of a combination tub and shower incorporating the present invention and showing it in an installed position.

The combination tub and shower unit shown in the drawings consists of a shell-like enclosure 11 which is formed as a self-contained, self-supporting module or unit. It can be formed of any suitable material such as high strength molded filberglass. Additional fiberglass is provided at the lower extremities of the enclosure to provide the additional rigidity and strength so that it can serve its intended functions. The shell-like enclosure forms a combination bathtub and shower stall. For this reason it is provided with a generally horizontal bottom wall 12 and a sidewall 13 extending upwardly from the bottom wall in a generally vertical direction to a height which is greater than that of an adult human being so that the enclosure can serve as a shower stall. The sidewall 13 can have any desired configuration. For example, as shown particularly in FIG. 2, the sidewall 13 can be formed of a generally planar rear wall 14 and another sidewall 17 which is substantially parallel to the sidewall 16. It is also formed with an inclined sidewall 18 which serves as a utility column as hereinafter described. The sidewall 18 is inclined at a suitable angle as for example an angle of approximately 45° with respect to the sidewall 17. It is also provided with a front wall 19 which is generally parallel to the rear wall 14. A large opening 21 is formed in the sidewall 13 of the shell-like enclosure 11 and is spaced a substantial distance above the bottom wall 12 so that the lower portion of the enclosure can serve as a deepsoak bathtub for an adult human being. The opening 21 is framed by a generally horizontal ledge 22 formed on the top of the front wall 19. It is also framed by the sidewall 16 and a sidewall 23 which is formed integral with the inclined sidewall 18. The ledge 22 is provided with an inclined decorative bevel 24. The sidewall 23 is also formed with an inclined decorative bevel 26.

The inclined sidewall 18, which is to serve as the utility column is provided with a relatively wide recess 28 extending vertically of the inclinded sidewall 18. The bottom wall 12 is provided with an anti-skid surface as shown.

The enclosure 11 is also provided with a wall member 31 (see FIG. 3) which extends from the side of the shell-like enclosure 11 and is formed integral with the sidewall 23. The wall member 31 extends generally in a direction at right angles to the sidewall 23 so that it lies in a plane which is parallel with the plane of the opening 21. It is provided with a frontal surface 32 which faces in the same direction as the opening 21. Wall member 31 is provided with a vertical nailing strip 33 which permit the enclosure 11 to be nailed directly to studs as hereinafter described. The sdiewall 16 is provided with a similar vertically extending nailing strip 34. Horizontal nailing strips 36 are provided on the top sides of the sidewalls 16 and 17 for a similar purpose.

The wall member 31 serves to define the front side of a service compartment 41 which is disposed immediately to the rear of the wall member 31 and immediately adjacent to the reverse side of the inclinded sidewall 18 which provides the utility column hereinbefore described. This service compartment 41 is made accessible through the wall member by providing a plurality of vertically spaced access openings 42 which are provided in a recess 43 formed in the wall member 31.

A decorative wall panel 46 is provided which is adapted to seat within the recess 43 and to cover the access openings 42. The wall panel 46 has such a thickness that when it is mounted in a recess 43 its outer surface will be flush with the frontal surface 32 of the wall member 31. Suitable means can be provided for removably securing the wall panel 46 to the wall member 31 and can consist of Velcro strips 47. The outer surface of the wall panel 46 can be provided with a decorative covering if desired.

Figure 2:
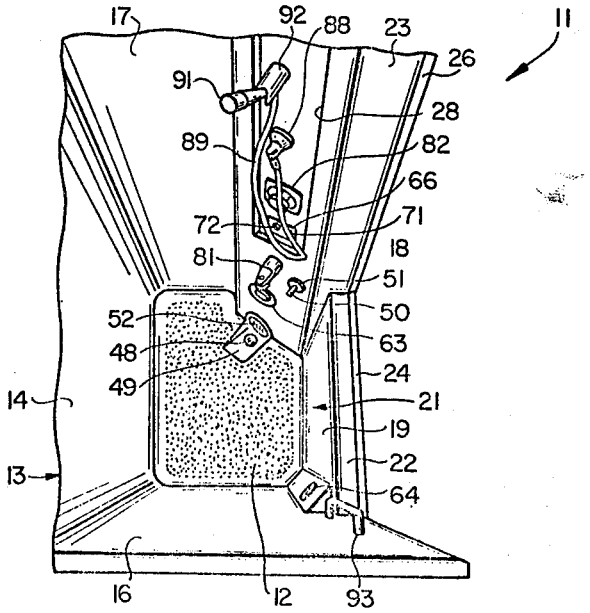
FIG. 2 is a perspective view looking downwardly into the combination tub and shower unit shown in FIG. 1.

In order to minimize installation costs, it is preferable that the shell-like enclosure be provided with the necessary electrical wiring and plumbing at the factory before shipment for connection to the standard house wiring and plumbing. For this purpose, the combination tub and shower which is formed from the shell-like enclosure is provided with sufficient plumbing attachments so that hydromassage bathing can be provided in the tub. A drain 48 of a conventional type is mounted in a recess 49 in the tub. The drain 48 is adapted to be opened and closed by hand by operation of a trip level 50 mounted in an overflow drain 51 carried by the wall 18. For hydromassage bathing, a suction fitting 52 is mounted in the utility column on the inclinded wall 18 adjacent to the bottom wall 12. This suction fitting is connected by piping 53 to a pump 54 of the conventional type. The pump 54 is driven by an electric motor 56 of a suitable type such as 110 volts 60 cycle AC. The pump 54 and motor 56 are secured to a bracket 57 by bolts 58. The braket 57 is secured to the wall member 31 by bolts 59. The output from the centrifugal pump 54 is supplied through piping 61 and piping 64 through two inlets 63 and 64 mounted in the lower portion of the enclosure 11 a distance above the bottom wall 12 and spaced below the ledge 22. Preferably as shown in FIG. 2, the suction inlets 63 and 64 are arranged so that they face in a direction towards the center of the tub portion of enclosure as shown in FIG. 2. The inlet heads 63 and 64 can be of any suitable type such as those disclosed in U.S. Pat. Nos. 3,297,025 or 3,540,438. An air control console 66 is mounted in the recess 28 provided on the utility column formed by the inclined sidewall 18. It also can be of a suitable type such as disclosed in U.S. Pat. No. 3,874,374. The control console is connected by piping 67 and 68 to the inlets 63 and 64 so that the amount of air which is introduced into the inlets can be readily adjusted by the control console 66. The control console is provided with a pair of knobs 71 and 72 accessible from the interior of the combination tub and shower so that they are readily accessible to the operator and so that the amount of air introduced into each of the inlets 63 and 64 can be individually adjusted.

Figure 3:
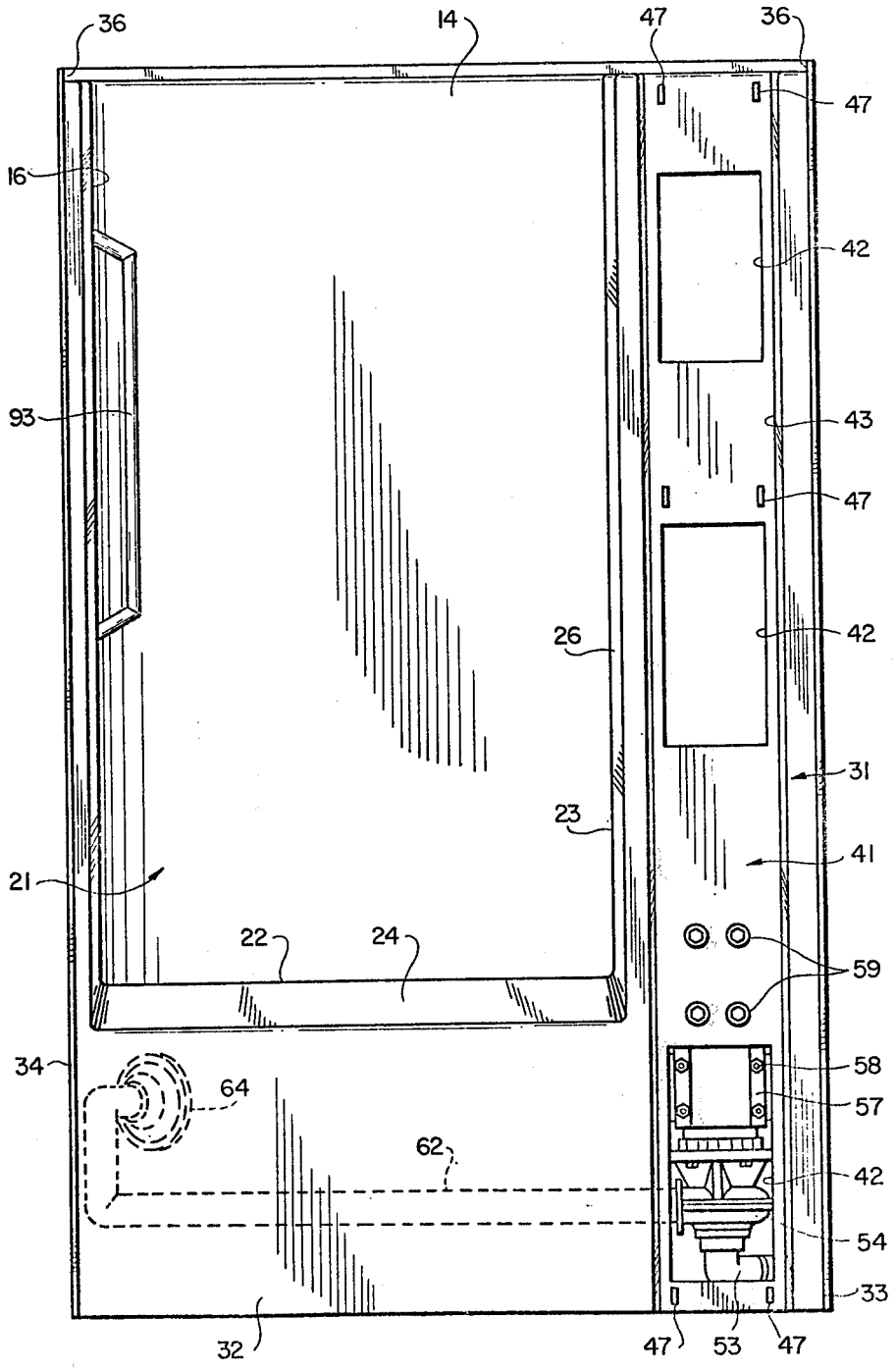
FIG. 3 is a frontal elevation view of the combination tub and shower unit shown in FIGS. 1 and 2 with the decorative front panel removed to expose the access openings to the service compartment.
Figure 4:
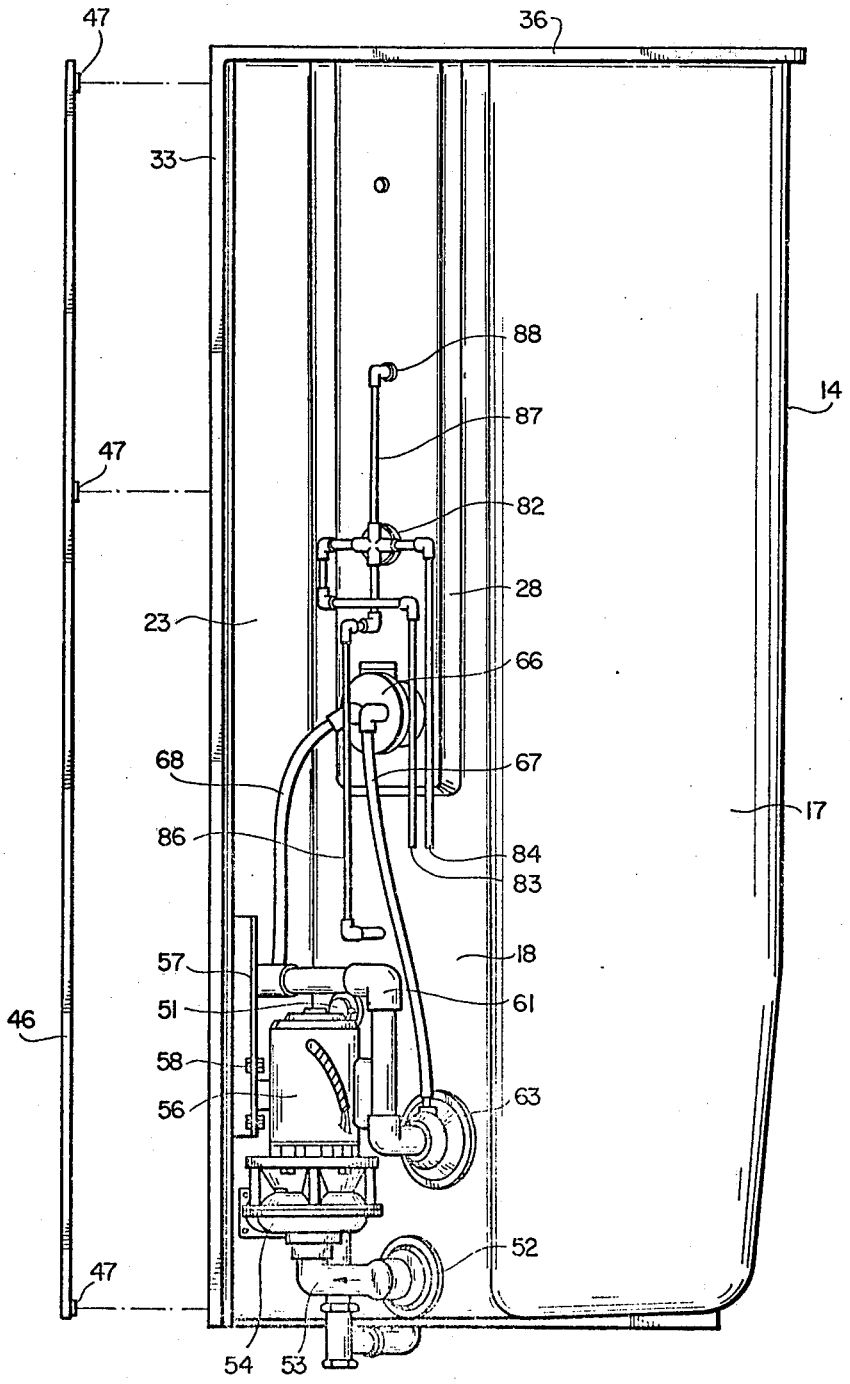
FIG. 4 is a side elevational view of the combination tub and shower unit shown in FIGS. 1, 2 and 3 and showing the service compartment with the front panel separated from the vertical wall member forming the service compartment.

If desired the other plumbing fixtures which are normally associated with the bathtub and the shower stall can be omitted so that custom type fixtures can be selected by the customer and installed at the time the combination tub and shower is placed in the housing. Such fixtures would include a conventional fillspout 81 mounted on the sidewall 18 immediately below the recess 28 shown in FIG. 2. Similarly, a control knob or mixing valve assembly 82 of a conventional type can be provided within the recess 28 of the utility column for controlling the flow of mixed hot and cold water from hot and cold water pipes 83 and 84 through a pipe 86 to the fillspout 81 so that the desired temperature of water in the bathtub can be provided. The fillspout 81 can be provided with a conventional hand operated lever (not shown) for causing the water to flow either through the fillspout 81 into the tub or alternatively to be directed upwardly through a pipe 87 to a fitting 88. As As shown in FIG. 3 the fitting 88 is connected to a flexible hose 89, the hose 89 is connected to a showerhead 91 which can be of a conventional European type mounted in a bracket 92 supported in the recess 28 of the utility column.

The combination tub and shower unit or module with hydromassage has fittings as shipped from the factory to the construction site whether it be for new housing or for a replacement unit. The housing in which the combination tub and shower is to be installed is provided with a standard size shower cove with an appropriate floor structure. The combination tub and shower can then be moved into the cove and can be secured in place by nailing the nailing strips 33, 34 and 36 to the framing member is provided in the housing unit. The drain 48 and the overflow 51 extend out of the bottom of the modular unit and are fitted over the drain pipe provided in the housing unit. The water and electrical supplies can now be connected. The additional tub and shower fixtures desired can be installed at the same time by utilizing access openings 42 provided in the wall member 31.

Hand rail 93 and other accessories can also be mounted at this time. After the plumbing and electrical wiring have been completed, the decorative front panel 46 can be put in place.

After the combination shower and tub has been nailed into place as hereinbefore described wallboard can be applied over the nailing strips and the wallboard can be finished in a conventional manner by taping and thereafter wallpapering the wallboard.

As shown in FIG. 1, it can be seen that the combination tub and shower when installed provides a very attractive appearance, the wallboard 94 which has been installed completely covers the nailing strips which have been utilized for securing the tub and shower in place.

The opening 21 in the combination tub and shower can be closed in a conventional manner by the use of shower curtain (not shown) or alternatively by the use of a shower door (not shown) of a conventional type.

The combination tub and shower can now be placed in use. It can be utilized as a conventional bath by closing the drain and filling the tub portion with the water to the desired level. If the hydromassage is to be utilized, the tub must be filled to a level which is substantially above the inlets 63 and 64. The electric motor 56 can then be placed in operation by operating a switch (not shown) to start the operation of the pump and to cause the circulation of the water from the tub through the inlets to create the hydromassage action. The effectiveness of the hydromassage action is affected by the amount of air inducted into the water. The air is controlled by use of the controls 71 and 72 to adjust the air intake into the manifold. As the controls are moved toward the closed position, air induction decreases. When the controls are in the closed position only water is circulated. To increase the force of the water from the inlet, the valve which is provided as a part of the inlet is rotated in one direction and to decrease the force of the water it is rotated in the opposite direction. To change the direction of the water flow the inlet can be swiveled to the desired angle.

Even though the combination tub and shower is of a size so that it can be mounted in a conventional shower stall cove, the tub portion of the same is more than adequate to accommodate an adult human being for deep water bathing for soaking and the use of hydromassage. In addition, the combination unit can also be utilized as a shower.

It can be seen that the enclosure which forms the module is of a seamless contour design which has no sharp ledges or crevices which can trap dirt or soap residue. By providing the readily removable access panel 46 it is possible to readily service and maintain the pump and motor and other plumbing utilized in the unit.

Since the unit is formed of fiberglass, it helps to retain the water at the desired temperature. Also since it is constructed of fiberglass it can be made available in a wide range of decorator colors and can be equipped with customized plumbing fixtures. The unit is of a type which can be readily installed as a replacement unit in existing housing or in new housing.

It should be appreciated that, if desired, the combination tub and shower can be made of a larger size. In such a case it may be desirable to provide wall 16 with an inclined upwardly and outwardly inclined surface so that the bather can readily rest his back against the inclined surface.

It can be seen, that the combination tub and shower has been designed with the utility column in which all of the plumbing fixtures of the interior system are positioned on the one column to minimize the surfaces on which the user could accidentally come in contact with the plumbing fixtures and possibly accidentally injure himself or herself. The mounting of these plumbing fixtures on the inclined sidewall which forms the utility column also faces in a direction in which they are readily accessible through the access openings provided in the wall member formed as a part of the unit. The construction of the combination tub and shower unit is such that it can be readily installed with the minimum of labor to thereby greatly reduce the cost of a conventional bathroom. It is also constructed in such a manner that it is relatively light in weight and can be readily shipped from the factory to the place of installation. It is also constructed in such a manner that it can be readily fastened into place.

It is claimed:

1. In a combination tub and shower for installation as a unit in housing having standard house plumbing, a shell-like enclosure formed of a generally horizontal bottom wall and a substantially vertical sidewall extending upwardly from the bottom wall to a height which is greater than that of an adult human being so that the enclosure can serve as a shower stall, said sidewall having an opening formed therein which is spaced a substantial distance above the bottom wall so that the lower portion of the enclosure can serve as a tub for an adult human being, said opening serving to permit ingress and egress of a human being with respect to the shower stall and the tub, a vertically extending wall member secured to one side of the enclosure and extending vertically of the enclosure and lying generally in a plane parallel to the plane of the opening in the sidewall, said wall member defining the front side of a service compartment, said wall member having front access openings therein to permit access to the service compartment, said tub and shower having plumbing fixtures connected directly to the house plumbing inside said service compartment so that plumbing connections for the tub and shower can be made through the front access openings and a panel removably secured to said wall member and serving to conceal said access openings.

2. A combination tub and shower as in claim 1 wherein said wall members are provided with a frontal surface which faces the same direction as the opening.

3. A combination tub and shower as in claim 1 wherein said sidewall includes an inclined sidewall portion forming a utility column which is in the vicinity of the service compartment.

4. A combination tub and shower as in claim 1 wherein said plumbing fixtures includes a suction head, a pump connected to the suction head and mounted in the service compartment, a motor mounted in the service compartment for driving said pump, at least one inlet head mounted in the tub portion of the enclosure and connected to the pump and controls carried by the service column for controlling the introduction of air into the inlets whereby hydromassage action can be provided in the tub portion of the enclosure.

5. A combination tub and shower as in claim 4 wherein the plumbing fixtures includes a showerhead mounted on the utility column and means for supplying water to the showerhead.

6. A combination tub and shower as in claim 1 wherein said unit is formed of fiberglass.

7. A combination tub and shower as in claim 6 wherein said enclosure is provided with nailing strips formed of fiberglass which are adapted to be used for securing the unit to framing studs forming part of the housing in which the enclosure is mounted.

8. A combination tub and shower as in claim 1 wherein said wall member is provided with a recess and said removable panel is mounted in said recess.

9. In a combination tub and shower installation for a housing unit having standard house plumbing and having a space for a combination tub and shower and being provided with framing studs and a bottom wall and having a drain and a supply of hot and cold water, the combination tub and shower comprising a shell-like enclosure formed of a generally horizontal bottom wall and a substantially vertical sidewall extending upwardly from the bottom wall to a height which is greater than that of an adult human being so that the enclosure can serve as a shower stall, said sidewall having an opening formed therein which is spaced a substantial distance above the bottom wall so that the lower portion of the enclosure can serve as a tub for an adult human being, said opening serving to permit ingress and egress of a human being with respect to the shower stall and the tub, a vertical wall member secured to one side of said enclosure and extending vertically of the enclosure and lying in a plane generally parallel to the place of the opening in the sidewall, said wall member forming the outside of a service compartment, said wall member having front access openings formed therein to permit access to the service compartment, said tub and shower having plumbing fixtures connected directly to the house plumbing inside said service compartment so that plumbing connections can be made to the tub and shower from the front, means for securing the combination tub and shower to the frame members of the housing unit and a panel removably secured to the wall member to close said access opening.

10. An installation as in claim 9 wherein said enclosure is formed of fiberglass and wherein said enclosure is provided with nailing strips also formed of fiberglass therein adapted to be nailed to the frame members.

11. An installation as in claim 10 wherein wallboard members forming a portion of the housing unit are adapted to overlie the nailing strips and conceal the same from view.

12. An installation as in claim 9, wherein said vertical sidewall is provided with an inclined portion serving as a utility column in close proximity to the service compartment and forming one side of the service compartment together with plumbing fixtures secured to the utility column.

* * * * *